US007365491B2

(12) United States Patent
Kang et al.

(10) Patent No.: US 7,365,491 B2
(45) Date of Patent: Apr. 29, 2008

(54) PLASMA DISPLAY PANEL HAVING DISCHARGE ELECTRODES BURIED IN BARRIER RIBS

(75) Inventors: Kyoung-Doo Kang, Suwon-si (KR); Won-Ju Yi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/287,202

(22) Filed: Nov. 28, 2005

(65) Prior Publication Data

US 2006/0113910 A1 Jun. 1, 2006

(30) Foreign Application Priority Data

Nov. 29, 2004 (KR) ..... 10-2004-0098742

(51) Int. Cl.
*H01J 17/49* (2006.01)

(52) U.S. Cl. ..... 313/583; 313/586; 313/292

(58) Field of Classification Search ..... 313/582–587, 313/292; 174/17; 439/55, 611
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,873,105 | B2 * | 3/2005 | Akiba | 313/586 |
| 7,015,643 | B2 * | 3/2006 | Kweon | 313/583 |
| 2005/0093444 | A1 * | 5/2005 | Woo et al. | 313/582 |
| 2005/0116646 | A1 * | 6/2005 | Yoo et al. | 313/582 |

(Continued)

FOREIGN PATENT DOCUMENTS

JP 2845183 10/1998

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Karabi Guharay
(74) *Attorney, Agent, or Firm*—Robert E. Bushnell, Esq.

(57) ABSTRACT

A plasma display panel includes a back substrate having back barrier ribs partitioning a plurality of discharge cells; a front substrate arranged to be opposite to the back substrate and having front barrier ribs partitioning the discharge cells in cooperation with the back barrier ribs; back discharge electrodes arranged within the back barrier ribs to enclose the discharge cells; front discharge electrodes arranged within the front barrier ribs to enclose the discharge cells; phosphor layers arranged within the discharge cells; and discharge gas arranged within the discharge cells.

18 Claims, 4 Drawing Sheets

U.S. PATENT DOCUMENTS

| | | | | |
|---|---|---|---|---|
| 2005/0225241 | A1* | 10/2005 | Woo et al. | 313/582 |
| 2005/0231113 | A1* | 10/2005 | Kang et al. | 313/582 |
| 2006/0001377 | A1* | 1/2006 | Hur et al. | 313/584 |
| 2006/0103308 | A1* | 5/2006 | Kweon | 313/582 |
| 2006/0125395 | A1* | 6/2006 | Kang | 313/582 |
| 2006/0132038 | A1* | 6/2006 | Kweon | 313/582 |
| 2006/0132040 | A1* | 6/2006 | Kweon | 313/583 |
| 2006/0238123 | A1* | 10/2006 | Kang | 313/582 |

FOREIGN PATENT DOCUMENTS

| | | |
|---|---|---|
| JP | 2917279 | 4/1999 |
| JP | 2001-043804 | 2/2001 |
| JP | 2001-325888 | 11/2001 |

* cited by examiner

PLASMA DISPLAY PANEL HAVING DISCHARGE ELECTRODES BURIED IN BARRIER RIBS

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 29 Nov. 2004 and there duly assigned Serial No. 10-2004-0098742.

BACKGROUND OF THE INVENTION

1. Field of the Invention

The present invention relates to a plasma display panel, and more particularly, to a plasma display panel having a new structure.

2. Description of the Related Art

In recent years, display apparatuses employing a plasma display panel as a flat display panel have been in wide use. Such display apparatuses have excellent characteristics such as high image quality, ultra thin thickness, small weight, and wide viewing angle, as well as large-sized screen. In addition, the display apparatuses can be simply manufactured and their size can be easily increased, compared to the others. Therefore, such display apparatuses have been in the spotlight as next-generation large-sized flat display apparatuses.

In the conventional three-electrode surface-discharge plasma display panel, visible rays emitted from the phosphor layers are absorbed, to a large degree (about 40%), by the sustain electrodes disposed on the lower surface of a front substrate, dielectric layers covering the electrodes and MgO films, whereby light emission efficiency decreases.

Further, in a case where the conventional three-electrode surface-discharge plasma display panel displays the same image for a period of time, charged particles of discharge gas are implanted into the phosphor layers, whereby permanent image sticking occurs.

Furthermore, a producing process is complicated because address electrodes and a lower dielectric layer are formed on a back substrate and barrier ribs are separately formed on the lower dielectric layer.

SUMMARY OF THE INVENTION

The present invention provides but is not limited to a plasma display panel having a novel structure, technique and method of making the plasma display panel.

According to an aspect of the present invention, there is provided a plasma display panel including: a substrate having barrier ribs partitioning a plurality of discharge cells; and discharge electrodes arranged within the barrier ribs to enclose the discharge cells.

According to another aspect of the present invention, there is provided a plasma display panel including: a back substrate having back barrier ribs partitioning a plurality of discharge cells; a front substrate arranged to be opposite to the back substrate and having front barrier ribs partitioning the discharge cells in cooperation with the back barrier ribs; back discharge electrodes arranged within the back barrier ribs to enclose the discharge cells; front discharge electrodes arranged within the front barrier ribs to enclose the discharge cells; phosphor layers arranged within the discharge cells; and discharge gas arranged within the discharge cells.

In the plasma display panel according to the present invention, strength of the barrier ribs increases because the barrier ribs are integrally formed with the substrate. Further, when manufacturing the plasma display panel, processes of producing an upper plate and a lower plate are very similar and producing processes are simplified. Therefore, overall manufacturing cost decreases.

Further, in the plasma display panel according to the present invention, a discharge surface can be significantly widened because a surface-discharge can occur in all side surfaces forming discharge cells. Specifically, since the discharge takes place at side surfaces forming discharge cells and then spreads toward center portions of the discharge cells, a discharge area is significantly increased, compared to that of a conventional plasma display panel, whereby the whole space of the discharge cells can be efficiently utilized. As a result, the discharge can take place at a low voltage, whereby luminous efficiency is significantly increased.

Further, the plasma display panel according to the present invention has a structure in which a low-voltage driving is made possible. Therefore, even though highly-concentrated Xe gas is used as discharge gas, the low-voltage driving is made possible, whereby the luminous efficiency is improved.

Further, the plasma display panel according to the present invention has a structure in which discharge response speed is fast and a low-voltage driving is made possible. Specifically, the discharge electrodes are disposed in the barrier ribs, not on the front substrate through which visible rays penetrate. Accordingly, the discharge response speed is fast and a low-voltage driving is made possible without distorting waveforms because it is possible to use an electrode having low resistance, for example, a metal electrode instead of a transparent electrode having high resistance as a discharge electrode.

Further, in the plasma display panel according to the present embodiment, it is possible to substantially prevent permanent image sticking. Specifically, electric field prevents ions generated by discharge from colliding with the phosphor layers although the discharge continues for a period of time because it allows plasma to intensively gather at center portions of the discharge cells due to a voltage applied on the discharge electrodes formed at side surfaces of the discharge cells. Therefore, it is possible to substantially prevent lasting afterimage arising from damage to the phosphor layers caused by ion sputtering. Specifically, the lasting afterimage is a critical problem when the highly-concentrated Xe gas is used as discharge gas. However, in the present invention, it is possible to substantially prevent lasting afterimage.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
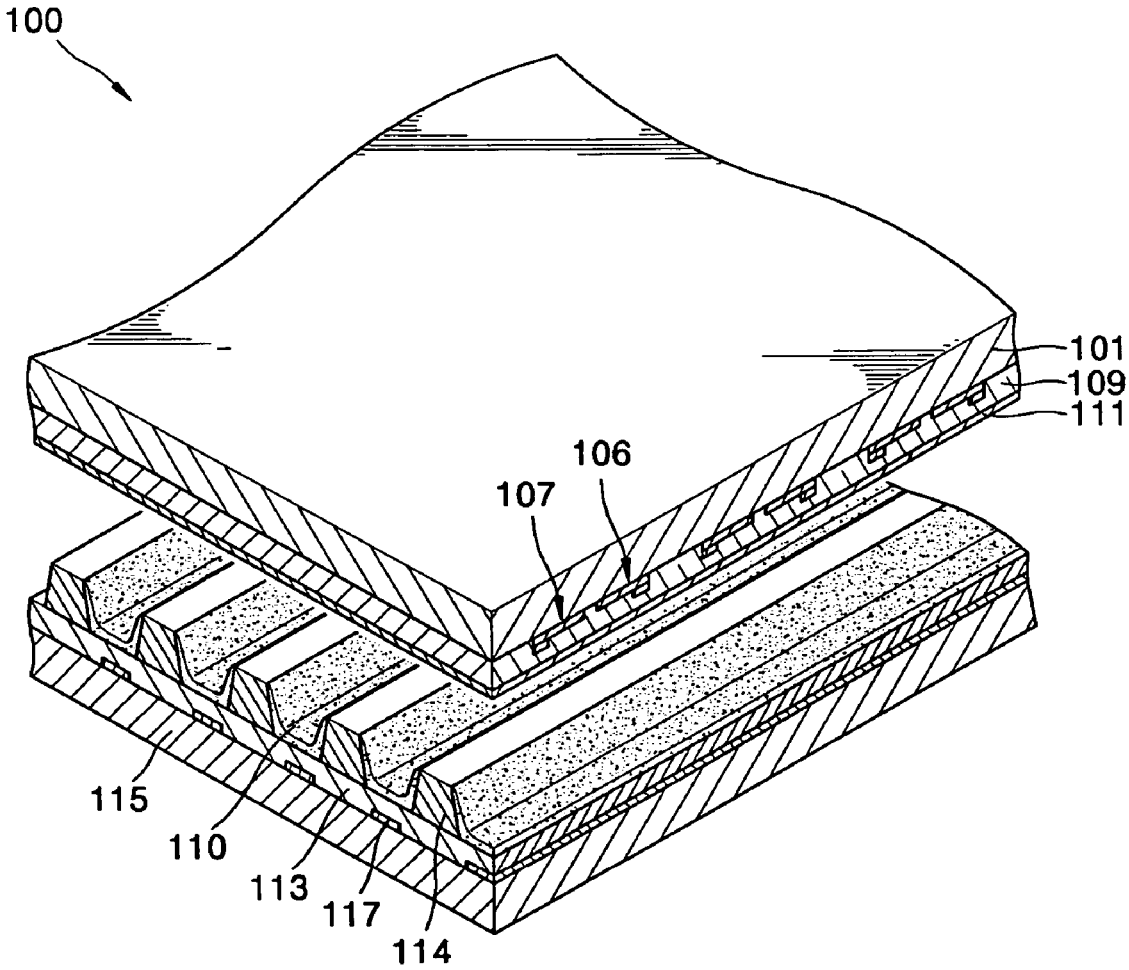
FIG. 1 (CONVENTIONAL ART)
FIG. 1 is an exploded perspective view illustrating a conventional plasma display panel.

Turning now to the drawings, in the conventional three-electrode surface-discharge plasma display panel 100 shown in FIG. 1, visible rays emitted from the phosphor layers 110 are absorbed, to a large degree (about 40%), by the sustain electrodes 106, 107 disposed on the lower surface of a front substrate 101, dielectric layers 109 covering the electrodes 106, 107, and MgO films 111, whereby light emission efficiency decreases.

Further, in a case where the conventional three-electrode surface-discharge plasma display panel 100 displays the same image for a period of time, charged particles of discharge gas are implanted into the phosphor layers 110, whereby permanent image sticking occurs.

Furthermore, a producing process is complicated because address electrodes 117 and a lower dielectric layer 113 are formed on a back substrate 115 and barrier ribs 114 are separately formed on the lower dielectric layer 113.

A plasma display panel 200 according to the embodiment of the present invention will be described in detail with reference to FIGS. 2 to 4.

The plasma display panel 200 according to the present invention includes an upper panel 250 and a lower panel 260 coupled to the upper panel 250. The lower panel 260 includes a back substrate 210, rear discharge electrodes 213, first dielectric layers 214, first protective layers 216, and first phosphor layers 215. The upper panel 250 includes a front substrate 220, front discharge electrodes 223, second dielectric layers 224, second protective layers 226, and second phosphor layers 225.

The back substrate 210 is generally made of materials whose major component is glass.

The front substrate 220 is arranged parallel to each other and apart from the back substrate 210 a predetermined distance and is made of a material having good light transmittance such as glass. Front transmittance of visible rays remarkably improves because sustain electrodes 106, 107, upper dielectric layers 109, protective layers 111 that exist in the front substrate of a conventional plasma display panel 100 do not exist in the front substrate 220. Therefore, if an image is embodied at the brightness level of a conventional technique, the electrodes 213, 223 may be driven with a relatively low voltage, so that luminous efficiency improves.

The back substrate 210 includes a back substrate portion 211 and rear barrier ribs 212. The back substrate portion 211 is a shape of a flat glass substrate. The rear barrier ribs 212 are arranged on the back substrate portion 211 opposite to the front substrate 220. The rear barrier ribs 212 and the back substrate portion 211 become one piece. FIG. 2 shows that the back (rear) barrier ribs 212 partition discharge cells 230 having a cross-section of a quadrilateral shape, but the discharge cells are not limited to that shape. The discharge cells can be formed in the various shapes as long as a plurality of discharge cells can be formed. For example, as in the present embodiment, a cross-section of the discharge cells can become polygon such as a triangle, a pentagon, etc., or an archetype, an oval, etc. in addition to a quadrilateral.

The front substrate 220 includes a front substrate portion 221 and front barrier ribs 222. The front substrate portion 221 is a shape of a flat glass substrate. The front barrier ribs 222 are arranged on the front substrate portion 221 opposite to the back substrate 210. The front barrier ribs 222 and the front substrate portion 221 become one piece. FIG. 2 shows that the front barrier ribs 222 partition the discharge cells 230 having a cross-section of a quadrilateral shape, but the discharge cells are not limited to that shape. The discharge cells can be formed in the various shapes as long as a plurality of discharge cells can be formed. For example, as in the present embodiment, a cross-section of the discharge cells can become a polygon shape such as a triangle, a pentagon, etc., or an archetype, an oval, etc. in addition to a quadrilateral. Further, the front barrier ribs 222 and the rear barrier ribs 212 may have different shapes, but it is preferable that they have the same shape.

Figure 4:
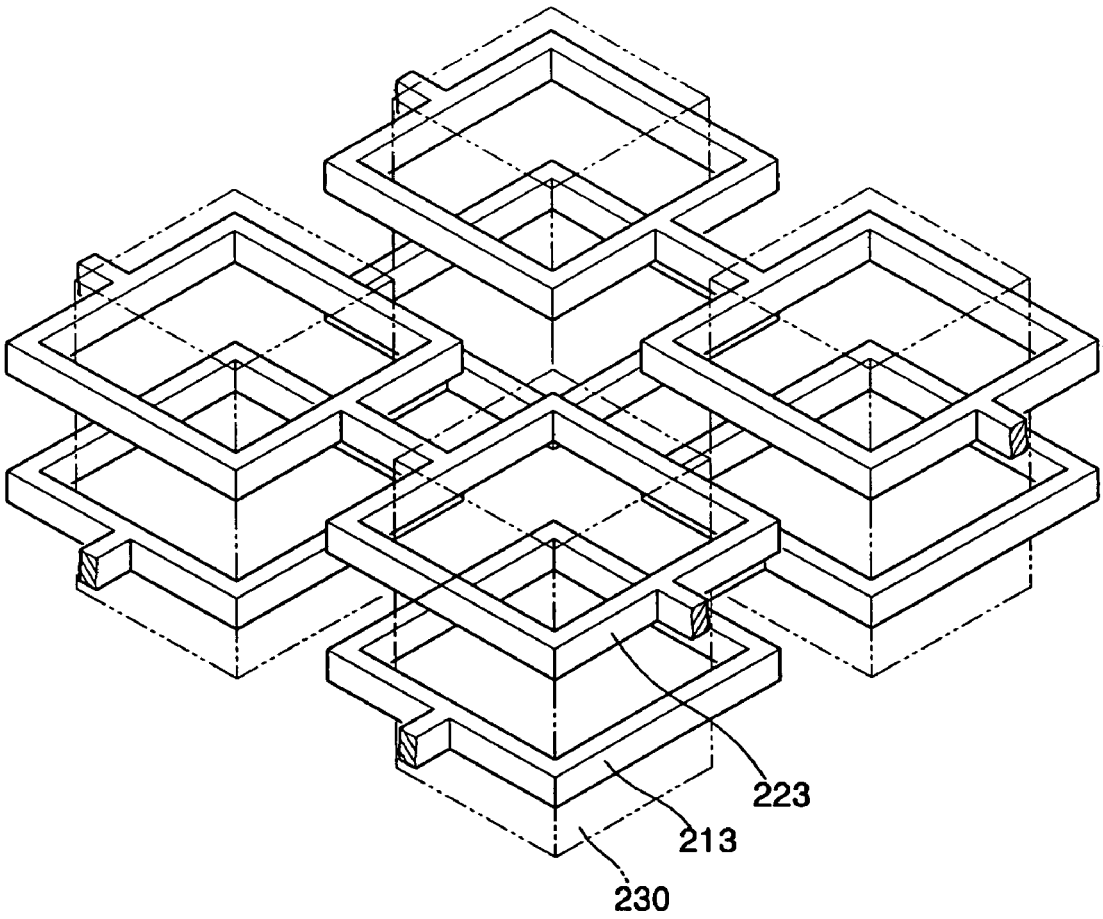
FIG. 4 is a diagram illustrating discharge cells and electrodes shown in FIG. 2.

As shown in FIG. 4, the rear discharge electrodes 213 are arranged to enclose the discharge cells 230. The rear discharge electrodes 213 have a plurality of quadrilateral-loops connected thereto and are arranged within the rear barrier ribs 212. The rear discharge electrodes 213 are extended to enclose each discharge cell 230 arranged in one direction. Specifically, the first grooves 211*a* of a quadrilateral-loop shape formed to enclose the discharge cells 230 are formed on upper surfaces of the rear barrier ribs 212 and the rear discharge electrodes 213 are arranged within the first grooves 211*a*.

The first dielectric layers 214 are buried into the first grooves 211*a* in which the rear discharge electrodes 213 are arranged. The first dielectric layers 214 are formed to have an electric insulation between the front discharge electrodes 223 and the rear discharge electrodes 213 and there are PbO, $B_2O_3$, $SiO_2$, etc. as such dielectric substances.

Further, as shown in FIG. 4, the front discharge electrodes 223 are arranged to enclose the discharge cells 230. The front discharge electrodes 223 are extended in the direction to intersect the direction in which the rear discharge electrodes 213 are extended and are arranged within the front barrier ribs 222. At this time, the front discharge electrodes 223 have a plurality of quadrilateral-loops connected thereto, similar to the structure of the rear discharge electrodes 213. The rear discharge electrodes 213 are extended to enclose each discharge cells 230 arranged in one direction. Specifically, the second grooves 221*a* having a quadrilateral-loop shape formed to enclose the discharge cells 230 are formed on the lower surfaces of the front barrier ribs 222 and the front discharge electrodes 223 are arranged within the second grooves 221*a*.

The second dielectric layers 224 are buried into the second grooves 221*a* in which the front discharge electrodes 223 are arranged. The second dielectric layers 224 are formed to have an electric insulation between the front discharge electrodes 223 and the rear discharge electrodes 213 and there are PbO, $B_2O_3$, $SiO_2$, etc. as such dielectric substances.

It is preferable that each of the loops of the front discharge electrodes 213 surrounding the discharge cells 230 and the loops of the rear discharge electrodes 223 are symmetrical to achieve uniform discharge within the discharge cells 230. In the plasma display panel 200 according to the present invention, the rear discharge electrodes 213 and the front discharge electrodes 223 have a two-electrode structure. Therefore, one of the front discharge electrodes 223 and the rear discharge electrodes 213 serves as scan and sustain electrodes and the other serves as address and sustain electrodes.

The front discharge electrodes 223 and the rear discharge electrodes 213 may be made of conductive metal such as aluminum, copper, etc., and thus they may have a small voltage drop in the length direction, so that it is possible to perform stable signal transmission.

The first grooves 211*a* and the second grooves 221*a* can be formed by various methods such as a sandblasting method and a photo-etching method, etc.

It is preferable that portions adjacent to portions in which the rear discharge electrodes 213 are arranged, among surfaces of the rear barrier ribs 212 are covered by MgO layers 216 as the first protective layers 216. Further, it is preferable that portions adjacent to portions in which the front discharge electrodes 223 are arranged, among surfaces of the front barrier ribs 222 are also covered by the MgO layers 226 as the second protective layers 226. The MgO layers 216, 226 are not an essential component, but prevent charged particle from colliding with the rear barrier ribs 212 and the front barrier ribs 222 and damaging them and emit many secondary electrons during the time of discharging.

Figure 2:
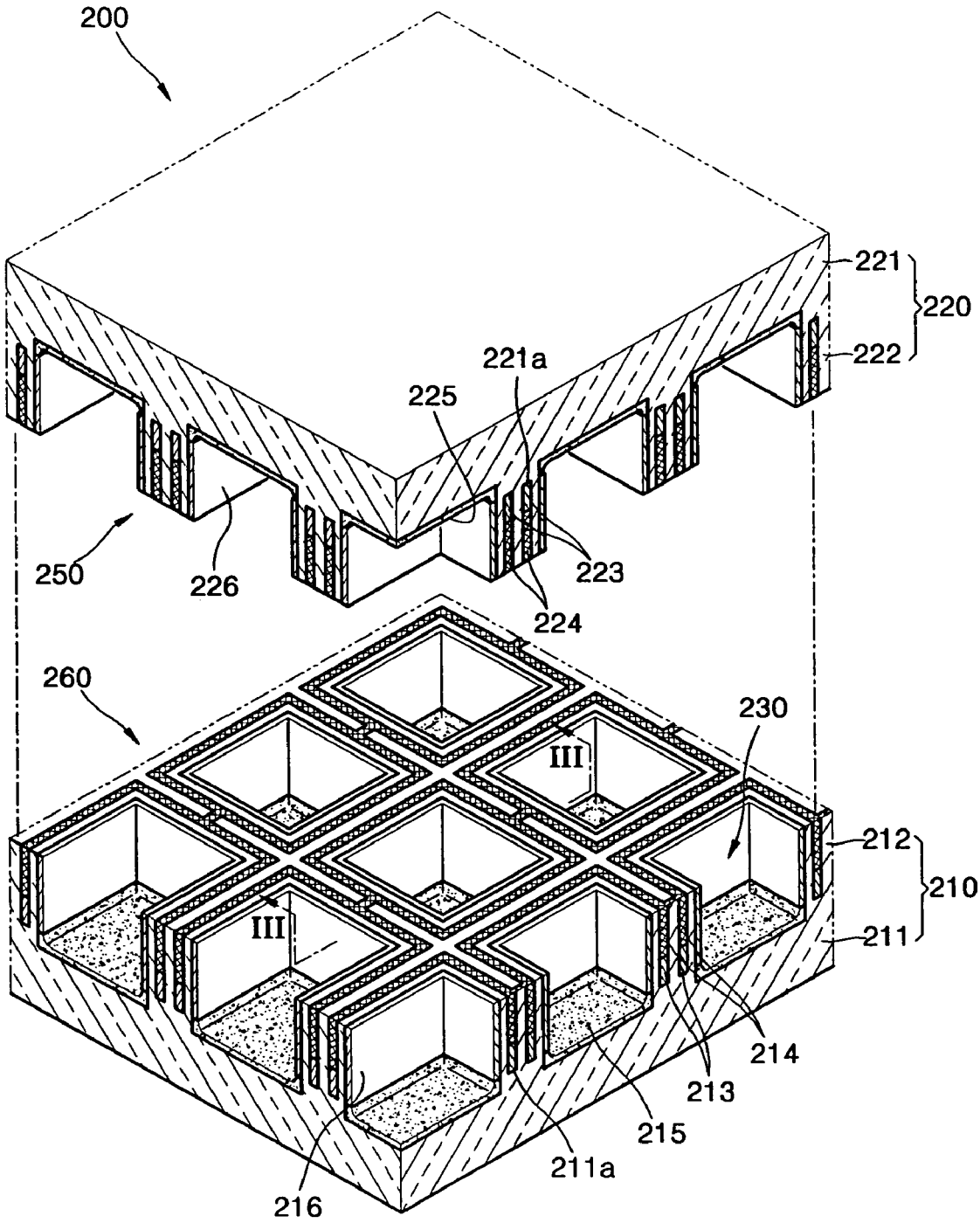
FIG. 2 is an exploded perspective view illustrating a plasma display panel according to a embodiment of the present invention.
Figure 3:
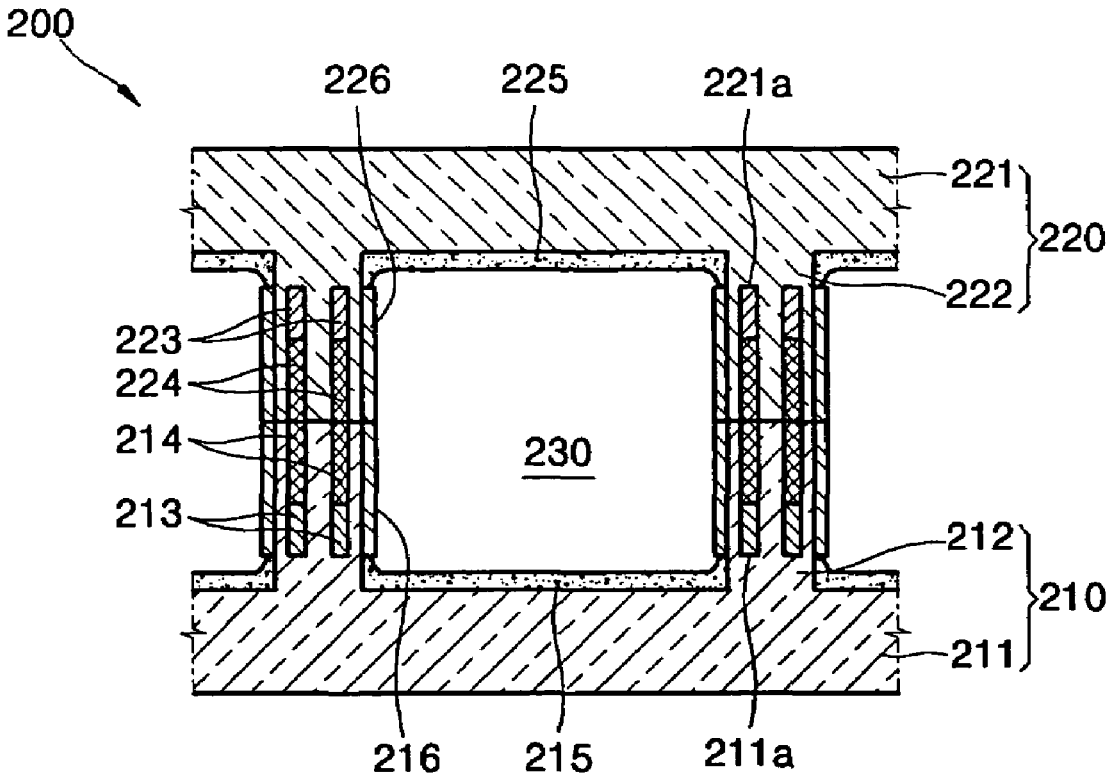
FIG. 3 is a cross-sectional view taken along III-III line shown in FIG. 2.

As shown in FIGS. 2 and 3, the first phosphor layers 215 are coated on the surfaces of the rear barrier ribs 212 and on the upper surface of the back substrate portion 211 between the rear barrier ribs 212. Specifically, the first phosphor layer 215 coated on the surfaces of the rear barrier ribs 212 are arranged between the first protective layers 216 and the back substrate portion 211. Further, the second phosphor layers 225 are coated on surfaces of the front barrier ribs 222 and on the lower surface of the front substrate portion 221 between the front barrier ribs 222. Similar to the first phosphor layers 215, the second phosphor layers coated on surfaces of the front barrier ribs 222 are arranged between the second protective layers 226 and the front substrate portion 221.

The first and second phosphor layers 215, 225 have components that receive ultraviolet rays and emit visible rays, and the phosphor layers formed on red-ray emitting discharge cells includes fluorescent substance such as Y (V, P)$O_4$:Eu, the phosphor layers formed on green-ray emitting discharge cells includes fluorescent substance such as $Zn_2SiO_4$:Mn, $YBO_3$:Tb, and the phosphor layers formed on blue-ray emitting discharge cells includes fluorescent substance such as BAM:Eu.

Discharge gas such as Ne, Xe, etc. and their mixture is filled and sealed in the discharge cells 230. In the present invention including the present embodiment, because a discharge surface increases, a discharge area expands, and an amount of generated plasma increases, so that it is possible to perform a low-voltage drive. Therefore, in the present invention, it is possible to perform a low-voltage drive even though a high concentrated Xe gas is used as the discharge gas, so that luminous efficiency can substantially improve. So, the problem can be solved of a low-voltage drive being very difficult when the high concentrated Xe gas is used as the discharge gas in a conventional plasma display panel.

Now, a method of manufacturing the plasma display panel 200 will be described in detail.

It is preferable that the upper panel 250 and the lower panel 260 in the plasma display panel 200 are separately produced and sealed and coupled to each other by a seal element such as frit glass.

First, a method of producing the upper panel 250 is as follows. The front substrate 220 having the front barrier ribs 222 and the front substrate portion 221 is formed by a sandblasting method after arranging a mask for forming the front barrier ribs on glass having a predetermined thickness. Thereafter, the second grooves 221*a* in which the front discharge electrodes 223 arranged are formed by a sandblasting method using a mask having the similar shape as the front discharge electrodes. The front discharge electrodes 223 are formed by a process of printing electrodes materials within the second grooves 221*a* after the second grooves 221*a* are formed and then by dry, exposure, developing, and firing processes. The second dielectric layers 224 are formed within the second grooves 221*a* by using a print method after the front discharge electrodes 223 are formed within the second grooves 221*a*. Thereafter, the second phosphor layers 225 are formed on the front substrate 220 by using a pattern print method or a photosensitive print method, etc. The protective layers 226 are formed by using a depositing method, etc., after the second phosphor layers 225 are formed.

A method of producing the lower panel 250 will not be described because it is similar to a method of producing the upper panel 260.

A method of producing the plasma display panel 220 according to the present invention, as described above, has an advantage in process efficiency and cost reduction because a process of producing the upper panel 250 and the lower panel 260 is simple and a process of producing both panels 250 and 260 is substantially the same.

In the plasma display panel 200 according to the first embodiment of the present invention having the above-mentioned structure, address discharge takes place between the front discharge electrodes 223 and the rear discharge electrodes 213 and as a result of the address discharge, the discharge cells 230 in which the sustain discharge is to takes place are selected. Thereafter, sustain discharge takes place between the front discharge electrodes 223 and the rear discharge electrodes 213 when an AC (alternating current) sustain discharge voltage is applied between the front discharge electrodes 223 and the rear discharge electrodes 213 in the selected discharge cells 230. Ultraviolet rays are emitted while energy level of the discharge gas excited by the sustain discharge is lowered. The ultraviolet rays excite the first and second phosphor layers 215, 225 coated within the discharge cells 230 and visible rays are emitted while energy level of the excited phosphor layers 215, 225 is lowered, and the emitted visible rays compose an image.

In the plasma display panel 200 according to the present invention, it is possible to perform double sided light emitting. However, it is preferable that the lower panel has elements for reflecting visible rays in order to prevent visible rays from being projected to the rear through the lower plate, when visible rays are projected through only the front substrate. Conversely, it is preferable that the upper plate has elements for reflecting visible rays in order to prevent visible rays from being projected to the front through the upper plate, when visible rays are projected through only the back substrate.

In a conventional plasma display panel shown in FIG. 1, the discharge area is relatively narrow because the sustain discharge between the sustain electrodes 106, 107 takes place in the horizontal direction. However, the sustain discharge of the plasma display panel 200 according to the present embodiment takes place in all sides defining the discharge cells 230 and its discharge area is relatively wide.

Further, the sustain discharge in the present embodiment is gradually spread to central portions of the discharge cells 230 after being formed in a closed circle along side surfaces of the discharge cells 230. Thereby, a generating area of the sustain discharge increases and space charges within the discharge cells which have been not used frequently in a conventional technique are contributed to light emitting. Therefore, luminous efficiency of the plasma display panel increases.

Further, in the plasma display panel according to the present embodiment, a problem with a conventional plasma display panel, that is, implantation of charged particles into fluorescent substance by ion sputtering is prevented because the sustain discharge is concentrated in center portions of the discharge cells, whereby permanent image sticking does not take place even if the same image is displayed for a period of time.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel comprising:

a substrate comprising barrier ribs defining a plurality of discharge cells;

a groove formed on a surface of each of the barrier ribs; the groove having a bottom formed inside the each of the barrier ribs, and having an open top formed on the surface of the each of the barrier ribs;

a discharge electrode arranged on the bottom of the groove; and a dielectric layer formed on the top of the discharge electrode; the dielectric layer filling the open top of the groove, the dielectric layer being made of a different material from the material of the barrier ribs.

2. The plasma display panel of claim 1, further comprising phosphor layers arranged within the discharge cells.

3. The plasma display panel of claim 2, wherein the phosphor layers are arranged on a substrate opposite to the discharge cells, the discharge cells to be arranged on a counter substrate.

4. The plasma display panel of claim 1, further comprising protective layers formed at surfaces of said barrier ribs.

5. The plasma display panel of claim 1, wherein said substrate comprises glass.

6. A plasma display panel comprising:

a back substrate comprising back barrier ribs partitioning a plurality of discharge cells;

a front substrate arranged to be opposite to said back substrate and including front barrier ribs partitioning the discharge cells in cooperation with said back barrier ribs;

back discharge electrodes arranged within said back barrier ribs to enclose the discharge cells;

front discharge electrodes arranged within said front barrier ribs to enclose the discharge cells;

a first phosphor layer formed on a surface of the back substrate facing the front substrate;

a second phosphor layer formed on a surface of the front substrate facing the back substrate; and discharge gas arranged within the discharge cells.

7. The plasma display panel of claim 6, wherein said front discharge electrodes extend to intersect the direction in which the back discharge electrodes extend.

8. The plasma display panel of claim 6, with a plurality of first grooves being formed in said back barrier ribs to enclose the discharge cells and said back discharge electrodes being arranged within the first grooves.

9. The plasma display panel of claim 8, further comprising first dielectric layers arranged within the first grooves and covering said back discharge electrodes.

10. The plasma display panel of claim 8, with said back discharge electrodes being arranged to enclose the discharge cells with loops connected and arranged within said back barrier ribs with first grooves formed to enclose the discharge cells formed on upper surfaces of said back barrier ribs and said back discharge electrodes arranged with the first groove.

11. The plasma display panel of claim 6, wherein second grooves are formed on said front barrier ribs to enclose the discharge cells and said front discharge electrodes are arranged within the second grooves.

12. The plasma display panel of claim 11, further comprising second dielectric layers arranged within the second grooves and covering said front discharge electrodes.

13. The plasma display panel of claim 6, further comprising a plurality of first protective layers formed at surfaces of said back barrier ribs in which the back discharge electrodes are arranged.

14. The plasma display panel of claim 6, further comprising a plurality of second protective layers formed at surfaces of the front barrier ribs in which the front discharge electrodes are arranged.

15. The plasma display panel of claim 6, wherein said back substrate comprises glass.

16. The plasma display panel of claim 6, wherein said front substrate comprises glass.

17. The plasma display panel of claim 6, with the front discharge electrodes, upper dielectric layers, protective layers not being included in said front substrate.

18. A display panel, comprising:

a first substrate comprising a plurality of first barrier ribs partitioning a plurality of discharge cells;

a second substrate arranged to be opposite to said first substrate and including second barrier ribs partitioning the discharge cells with said first barrier ribs;

a plurality of first discharge electrodes arranged within said first barrier ribs to enclose the discharge cells, a plurality of first grooves are formed in said first barrier ribs to enclose the discharge cells and said first discharge electrodes are arranged within the first grooves;

a plurality of second discharge electrodes arranged within said second barrier ribs to enclose the discharge cells, second grooves are formed on said second barrier ribs to enclose the discharge cells and said second discharge electrodes are arranged within the second grooves;

a plurality of first dielectric layers being arranged within the first grooves and covering said first discharge electrodes;

a plurality of second dielectric layers arranged within the second grooves and covering said second discharge electrodes;

a plurality of first protective layers formed at surfaces of said first barrier ribs in which said first discharge electrodes are arranged; and a plurality of second protective layers formed at surfaces of said second barrier ribs in which said second discharge electrodes are arranged.

* * * * *